United States Patent [19]

Whitten

[11] 3,952,588

[45] Apr. 27, 1976

[54] APPARATUS FOR TESTING EARTH FORMATIONS

[75] Inventor: Frank R. Whitten, Houston, Tex.

[73] Assignee: Schlumberger Technology Corporation, New York, N.Y.

[22] Filed: Jan. 22, 1975

[21] Appl. No.: 543,086

[52] U.S. Cl. ..... 73/155
[51] Int. Cl.[2] ..... E21B 47/10
[58] Field of Search ..... 73/151, 155, 421 R

[56] References Cited

UNITED STATES PATENTS

| | | | |
|---|---|---|---|
| 3,254,531 | 6/1966 | Briggs, Jr. | 73/155 |
| 3,677,080 | 7/1972 | Hallmark | 73/155 |

*Primary Examiner*—Jerry W. Myracle
*Attorney, Agent, or Firm*—Ernest R. Archambeau, Jr.; William R. Sherman; Stewart F. Moore

[57] ABSTRACT

In the representative embodiment of the new and improved apparatus for testing earth formations disclosed herein, fluid-admitting means are sealingly engaged with a potentially-producible formation and a selectively-movable chamber is expanded to draw mudcake and other plugging materials from the isolated face of the formation into the receiving chamber. Thereafter, the chamber is shifted to communicate the screened entry port of the fluid-admitting means with the isolated formation so as to retard or prevent the erosion of loose formation materials as the formation is tested. When the testing is completed, the chamber is cleared and returned to its initial port-closing position and the fluid-admitting means disengaged to ready the apparatus for subsequent operations.

25 Claims, 6 Drawing Figures

APPARATUS FOR TESTING EARTH FORMATIONS

Figures 1, 4:
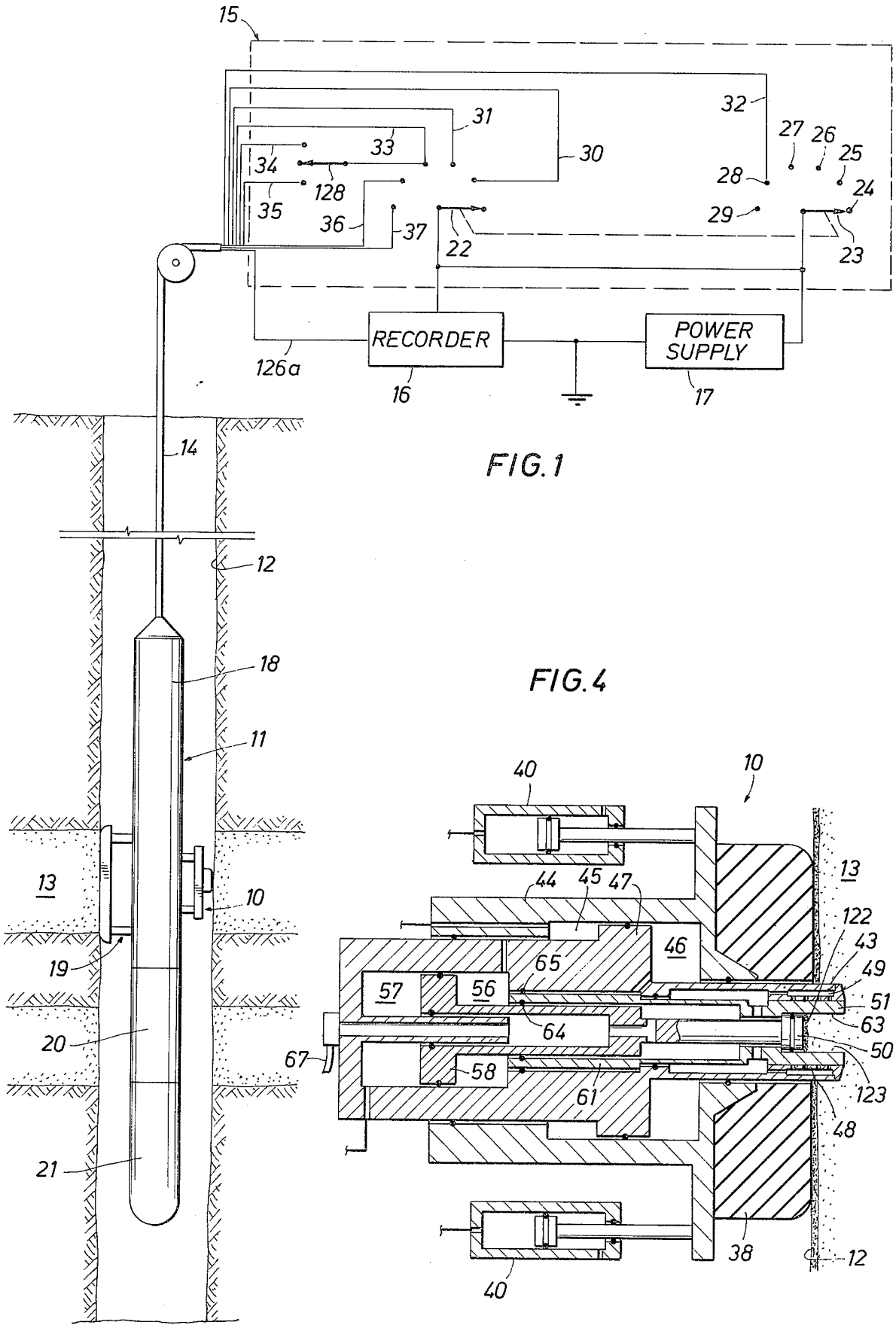

Those skilled in the art will, of course, recognize that the repetitively-operable wireline formation testers described in U.S. Pat. No. 3,780,575 represent one of the most-significant advances in the field of formation testing since those new and improved formation testers are particularly adapted for obtaining any number of pressure measurements as well as one or two fluid samples during a single trip into a well bore. It will be realized, moreover, that the commercial success of any formation-testing operation will be dependent upon the ability of a given formation tester to remain in isolated pressure or fluid communication with a formation which is being tested.

Thus, where relatively-soft or incompetent formations are being tested, it is essential that the fluid entry of the formation tester be provided with a suitable filter for at least retarding, if not altogether halting, the erosion of loose or unconsolidated formation materials into the tester as a fluid sample is being secured. As shown in U.S. Pat. No. 3,352,361, U.S. Pat. No. 3,530,933, U.S. Pat. No. 3,565,169 and U.S. Pat. No. 3,653,436, for example, various filtering arrangements have been provided heretofore where only a single test is to be made. The problem of maintaining such isolated communication is, however, significantly complicated where repetitive tests are to be made since any successful filtering arrangement must be capable of reliably operating with various types of competent and incompetent formations as well as be of such a design that plugging materials can be readily removed before a subsequent test is performed. For example, in U.S. Pat. No. 3,813,936, the filtering arrangement initially employed with the new and improved formation testers described in the aforementioned U.S. Pat. No. 3,780,575 is shown as including a tubular filter which covers the fluid entry and is normally covered by a selectively-movable valve member. In operating that tool, the valve member is retracted to uncover the filter screen and borehole fluids are briefly flushed through the screen to clear it of potentially-plugging materials before the testing and sampling operations are commenced.

Experience has shown, however, that this arrangement and operating technique is not always successful where, for example, the exposed wall of a formation being tested is coated with an unusually-thick layer of mudcake. For instance, where the formation being tested is composed of relatively-unconsolidated and very-small particles or sand grains, the filter screen must necessarily have correspondingly-small filter passages for retaining the loosened formation particles. As a result, therefore, the typically-larger particles of mudcake collected at the rear of the filter will easily plug at least the rearwardmost filter passages even though the filter was completely flushed before the testing and sampling operations are started. A similar, if not more serious, problem will also arise even where the formation being tested is relatively competent since the inflowing mudcake particles will not be collected at the rear of the tubular filter but will instead swirl around within the filter and often plug or coat the entire filter. In either case, the subsequent tests will be inconclusive since it will not be known whether the filter screen was plugged at the outset of the test or the formation being tested was actually non-productive. It will, of course, be recognized that the problem cannot be easily corrected by simply using large filter passages since a single trip into a given well bore may require the successive testing of highly-competent formations as well as unconsolidated formations composed of loose particles of widely-varying grain sizes.

Accordingly, it is an object of the present invention to provide new and improved formation-testing apparatus for reliably obtaining multiple measurements of one or more fluid or formation characteristics as well as selectively collecting one or more samples of connate fluids, if desired, from earth formations of any nature, with particular emphasis being given to preventing the premature plugging of the sample entry of the apparatus.

This and other objects of the present invention are attained by providing formation-testing apparatus having new and improved fluid-admitting means adapted for selective movement into sealing engagement with a potentially-producible earth formation and including filtering means in the fluid inlet for retaining loose formation materials which may be present in the isolated formation. To prevent mudcake particles or the like from plugging the filtering means, the new and improved fluid-admitting means further include particle-collecting means cooperatively arranged for selective movement between a normal extended position for collecting plugging materials and blocking the filtering means and a retracted position for withdrawing those materials from the flow path through the now-exposed filtered fluid inlet.

Figure 2A:
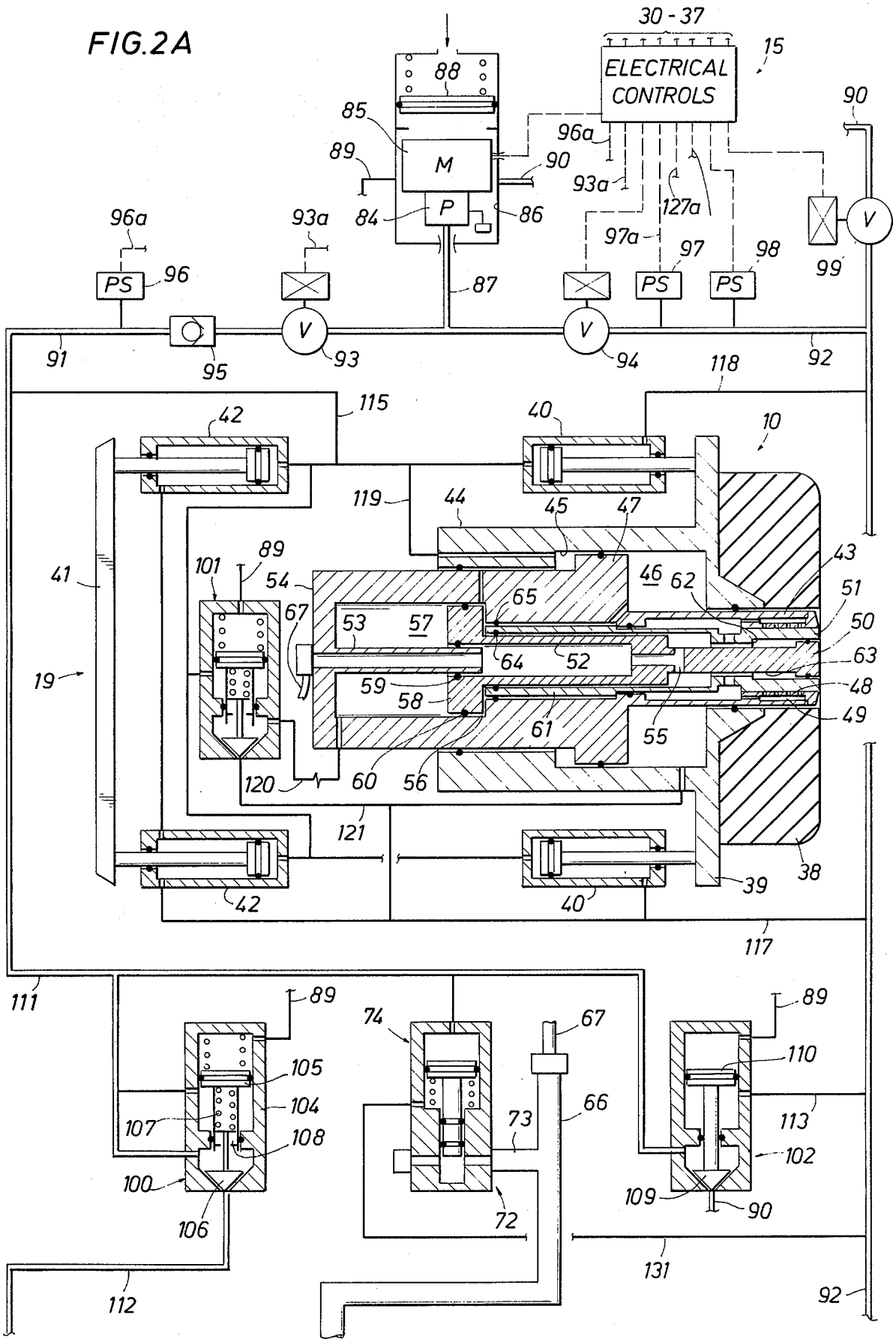
Figure 2B:
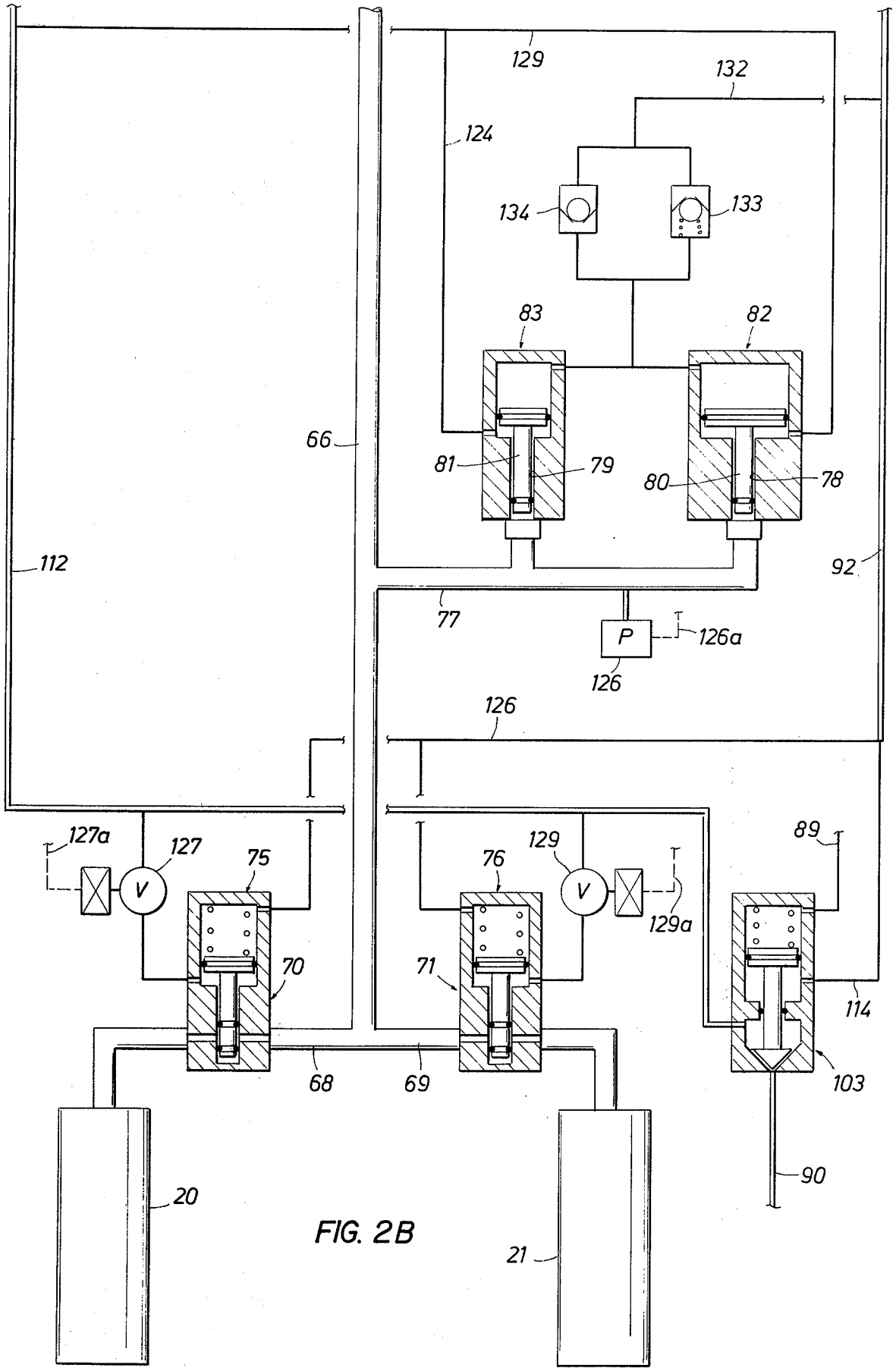
Figure 3:
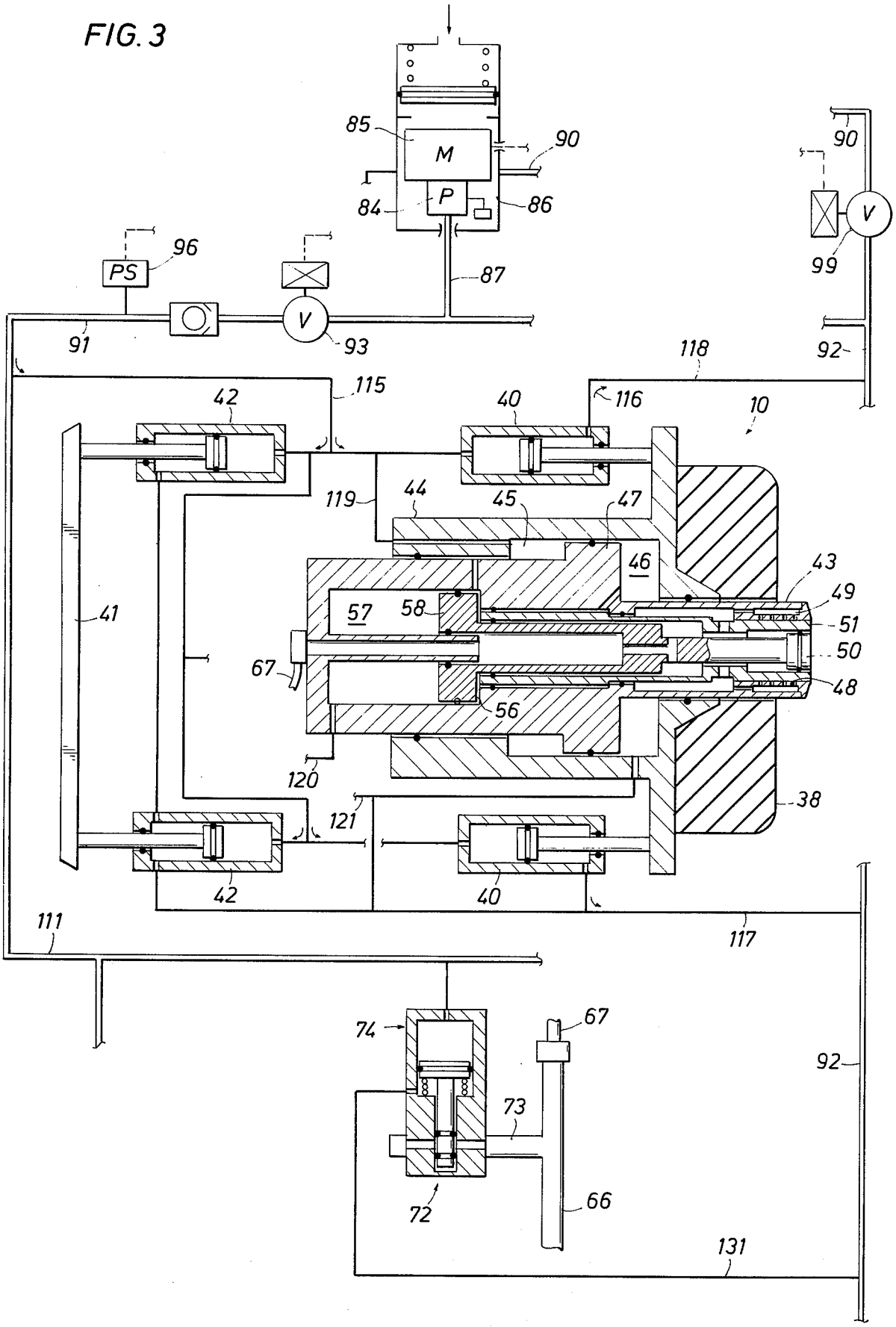
Figure 5:
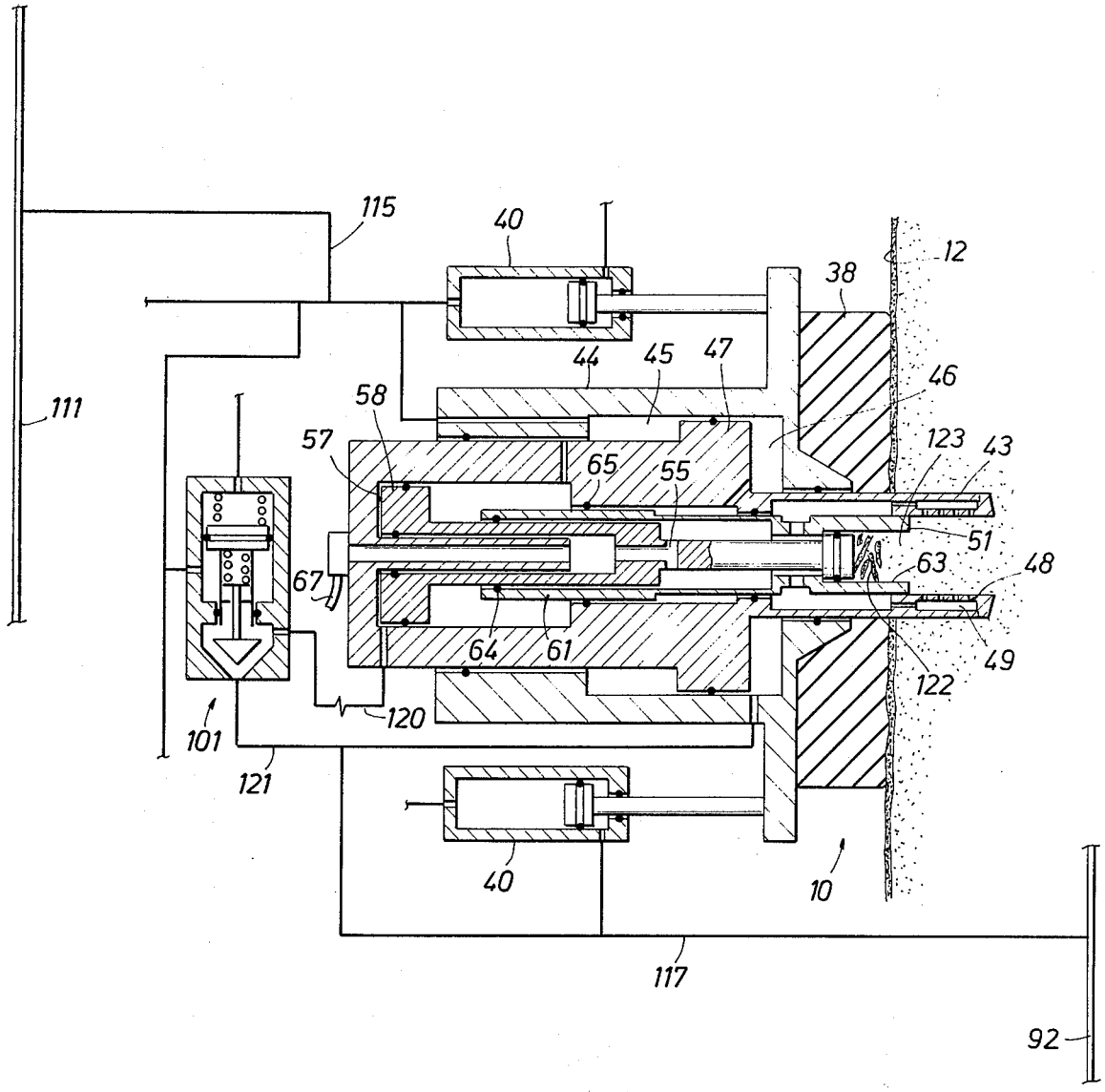

The novel features of the present invention are set forth with particularity in the appended claims. The invention, together with further objects and advantages thereof, may be best understood by way of the following description of exemplary apparatus employing the principles of the invention as illustrated in the accompanying drawings, in which:

FIG. 1 depicts the surface and downhole portions of new and improved formation-testing apparatus including a preferred embodiment of fluid-admitting means incorporating the principles of the present invention;

FIGS. 2A and 2B together show a somewhat-schematic representation of the formation-testing tool illustrated in FIG. 1 as the tool will appear in its initial operating position; and FIGS. 3–5 respectively depict the successive positions of various components of the new and improved tool shown in FIGS. 2A and 2B during the outset of a typical testing and sampling operation to illustrate the operation of the fluid-admitting means of the present invention.

Turning now to FIG. 1, fluid-admitting means 10 incorporating the principles of the present invention along with a preferred embodiment of a new and improved sampling-and-measuring tool 11 are shown as the tool will appear during the course of a typical measuring and sampling operation in a well bore such as an uncased borehole 12 penetrating one or more earth formations as at 13. As illustrated, the tool 11 is suspended in the borehole 12 from the lower end of a typical multiconductor cable 14 that is spooled in the usual fashion on a suitable winch (not shown) at the surface and coupled to the surface portion of a tool-control system 15 as well as to typical recording-and-indicating apparatus 16 and a power supply 17. In its preferred embodiment, the tool 11 includes an elongated body 18 which encloses the downhole portion of the tool-control system 15 and carries selectively-extendible tool-anchoring means 19 arranged on the opposite side of the body from the new and improved fluid-admitting means 10 as well as a pair of tandemly-coupled fluid-collecting chambers 20 and 21.

As is explained in greater detail in the aforementioned U.S. Pat. No. 3,780,575 which is hereby incorporated by reference, the new and improved formation-testing tool 11 and the control system 15 are cooperatively arranged so that, upon command from the surface, the tool can be selectively placed in any one or more of five selected operating positions. As will be subsequently described, the control system 15 will function either to successively place the tool 11 in one or more of these positions or else to selectively cycle the tool between various one of these operating positions. These five operating positions are conveniently achieved by selectively moving suitable control switches, as schematically represented at 22 and 23, included in the surface portion of the control system 15 to various switching positions, as at 24–29, so as to selectively apply power to different conductors 30–37 in the cable 14.

The new and improved fluid-admitting means shown generally at 10 in FIG. 1 and in more detail in FIG. 2A are cooperatively equipped for selectively sealing-off or isolating selected portions of the wall of the borehole 12; and, once a selected portion of the borehole wall is packed-off or isolated from the borehole fluids, establishing pressure or fluid communication with the adjacent earth formation, as at 13. In the particular embodiment of the tool 11 depicted, the new and improved fluid-admitting means 10 include an elastomeric annular sealing pad 38 mounted on the forward face of an upright support plate 39 that is coupled to a longitudinally-spaced pair of laterally-movable piston actuators, as at 40, which are arranged transversely on the tool body 18 for moving the sealing pad back and forth in relation to the forward side of the tool body. Similarly, the tool-anchoring means 19 include a wall-engaging member 41 that is also coupled to a longitudinally-spaced pair of laterally-movable piston actuators, as at 42, which are arranged in the same manner as the piston actuators 40 for carrying the tool-anchoring member back and forth in relation to the rearward side of the tool body 18. Accordingly, as will be subsequently explained, whenever the control system 15 selectively supplies a pressured hydraulic fluid to the piston actuators 40 and 42, the tool anchor 41 and the sealing pad 38 will each be moved laterally between a retracted position adjacent to their respective side of the tool body 18 and an advanced or extended wall-engaging position.

By situating the sealing member 38 on the opposite side of the tool body 18 from the tool-anchoring member 41, the contemporaneous extension of these two wall-engaging members will, of course, be effective for urging the sealing pad into sealing engagement with the adjacent wall of the borehole 12 as well as for anchoring the tool 11. It should, however, be appreciated that the tool-anchoring member 41 would not be needed if the piston actuators 40 are capable of extending the sealing pad 38 into firm sealing engagement with one wall of the borehole 12 when the rear of the tool body 18 is securely anchored against the opposite wall of the borehole. Conversely, the piston actuators 40 would be similarly omitted where extension of the anchoring member 41 alone would be effective for moving the front side of the tool body 18 forwardly toward one wall of the borehole 12 so as to place the sealing pad 38 into firm sealing engagement therewith. However, it is preferred that both the fluid-admitting means 10 and the tool-anchoring member 41 be designed for contemporaneous extension to enable the tool 11 to be operated in boreholes of substantial diameter.

To conduct connate fluids into the testing tool 11, as best seen in FIG. 2A the new and improved fluid-admitting means 10 further include a tubular member 43 having an open forward portion coaxially disposed within the annular sealing pad 38 and a closed rear portion which is slidably mounted within a larger tubular member 44 projecting from the rear face of the support plate 39. The nose of the fluid-admitting member 43 is preferably arranged to normally be about flush with the face of the sealing pad 38 so that extension of the fluid-admitting means 10 will engage the nose with the wall of the borehole 12 just as the sealing pad is also forced thereagainst for isolating that portion of the borehole wall as well as the nose of the fluid-admitting member from the borehole fluids. To selectively move the fluid-admitting member 43 in relation to the larger outer member 44, the tubular members are cooperatively equipped to define enclosed piston chambers 45 and 46 within the outer member and on opposite sides of an outwardly-enlarged intermediate portion 47 of the inner member which, of course, functions as a piston member. Thus, by applying an increased hydraulic pressure in the rearward chamber 45, the fluid-admitting member 43 will be moved forwardly in relation to the outer member 44 as well as to the sealing pad 38. Conversely, upon the application of an increased hydraulic pressure to the forward piston chamber 46, the fluid-admitting member 43 will be retracted in relation to the outer tubular member 44 and the sealing pad 38.

The new and improved fluid-admitting means 10 further include particle-collecting means which, in the preferred embodiment of the present invention, include a tubular filtering member 48 coaxially mounted within the nose of the fluid-admitting member 43 and spaced inwardly therefrom to define an annular fluid-receiving space 49 thereby providing a screened fluid entry for the fluid-admitting means. To control communication through the fluid-admitting means 10, an elongated plunger member 50 is coaxially disposed within an elongated tubular member 51 that are in turn coaxially arranged in the fluid-admitting member 43 for axial movement between a retracted or filter-exposing position and the illustrated advanced or filter-blocking position where the forward end of the plunger substantially closes off the nose of the fluid-admitting member and the forward portion of the tubular member covers the filtering member 48. To support the plunger member 50 and the tubular filter-covering member 51, the rearward portion of the plunger is axially hollowed, as at 52, and sealingly disposed over a small tubular member 53 projecting forwardly from the transverse wall 54 closing the rear end of the fluid-admitting member 43. The axial bore 52 is extended forwardly along the plunger member 50 and terminated by one or more lateral ports 55 in the mid portion of the plunger so as to define a continuous fluid passage between the fluid-receiving space 49 and the internal bore of the fixed tubular member 53.

To selectively move the plunger member 50 in relation to the fluid-admitting member 43, these members are cooperatively arranged as illustrated to define enclosed piston chambers 56 and 57 ahead of and behind the enlarged rearward end 58 of the plunger which is sealed, as at 59 and 60, to serve as an actuating piston for the plunger. Forward movement of the filter-covering member 51 is achieved by arranging the enlarged rearward portion 61 of that member to be engaged by the enlarged piston portion 58 of the plunger member 50 as it is moved forwardly. On the other hand, rearward movement of the filter-covering member 51 is accomplished by providing an inwardly-projecting shoulder 62 in the inner bore 63 of the tubular member which is engaged by the enlarged forward end of the plunger 50 as the plunger is moved toward its retracted position. As will subsequently be explained in greater detail, the filter-covering member 51 is fluidly sealed, as at 64 and 65, in relation to the plunger member 50 and the fluid-admitting member 43 so as to enable its enlarged rearward portion to serve as a piston for normally biasing the filter-covering member toward its forward position as the plunger is initially moving toward its retracted position. Accordingly, the plunger member 50 as well as the filter-covering member 51 will be moved forwardly in relation to the fluid-admitting member 43 upon an increase of hydraulic pressure in the rearward piston chamber 57. Conversely, an increased hydraulic pressure in the forward piston chamber 56 will be effective for retracting the plunger member 50 and expanding the forward portion of the inner bore 63 to provide an expansible particle-collecting chamber. Then, once the shoulder 62 and the plunger head are co-engaged, the continued rearward movement of the plunger will retract the filter-covering member 51 as the plunger 50 moves to its fully-retracted position.

In FIGS. 2A and 2B, the new and improved fluid-admitting means 10 as well as the entire downhole portion of the control system 15, the tool-anchoring member 41, and the fluid-collecting chambers 20 and 21 are schematically illustrated with their several elements or components depicted as they will respectively be positioned when the tool 11 of the present invention is fully retracted and the control switches 22 and 23 are in their first or "off" operating positions 24 (FIG. 1). Since the aforementioned U.S. Pat. No. 3,780,575 fully describes the underlying principles of the control system 15 and most of the various components of the tool 11, it is believed adequate to simply cover only the major aspects of these previously-described items as the present invention is described in detail.

A sample or flow line 66 is cooperatively situated in the formation-testing tool 11 and has its upper end coupled, as by a flexible conduit or hose 67, to the rear of the tube 53 on the fluid-admitting member 43 and its lower end terminated in a pair of branch conduits 68 and 69 respectively coupled to the fluid-collecting chambers 20 and 21 by way of a pair of normally-closed control valves 70 and 71. It will be seen, therefore, that the plunger member 50 in the new and improved fluid-admitting means 10 controls the communication with the upper end of the flow line 66 and that the control valves 70 and 71 control the communication with the lower end of the flow line. For reasons which will subsequently be described, a normally-open control valve 72 which is preferably similar to the normally-closed control valves 70 and 71 is cooperatively arranged in a branch conduit 73 for selectively controlling communication between the borehole fluids exterior of the tool 11 and the intermediate portion of the flow line 66 between these latter two valves and the fluid-admitting means 10.

As illustrated, the normally-open control valve 72 is operated by a typical pressure-responsive actuator 74 which is designed for closing the valve in response to an actuating pressure of at least a predetermined magnitude. As fully described in the aforementioned U.S. Pat. No. 3,780,575, a spring biasing the control valve 72 to its open position cooperatively establishes the magnitude of the pressure required to close the valve. The normally-closed control valves 70 and 71 are similarly equipped except that they are respectively operated by pressure-responsive actuators 75 and 76 selectively designed for opening these valves in response to a pressure of a different predetermined magnitude.

In keeping with the invention described in U.S. Pat. No. 3,859,851 (which is hereby incorporated by reference), a branch conduit 77 is coupled to the flow line 66 at a convenient location between the sample-chamber control valves 70 and 71 and the fluid-admitting means 10, with this branch conduit being terminated at the respective inlets of two fluid-expansion chambers 78 and 79 of predetermined, but minor, volumes. Reduced-diameter displacement pistons 80 and 81 are respectively mounted in the expansion chambers 78 and 79 and arranged to be selectively moved at controlled rates between predetermined upper and lower positions upon operation of typical pressure-responsive piston actuators, such as shown generally at 82 and 83, which are operatively coupled to the displacement pistons respectively. Accordingly, it will be appreciated that upon application of an increased hydraulic pressure to the lower portions of the two piston actuators 82 and 83, the displacement pistons 80 and 81 will be respectively moved to their upper positions for expanding their associated displacement chambers 78 and 79. Conversely, the displacement pistons 80 and 81 will be respectively returned to their lower positions when there is an increased hydraulic pressure in the upper portions of the piston actuators 82 and 83.

As best seen in FIG. 2A, the control system 15 further includes a pump 84 that is coupled to a driving motor 85 and cooperatively arranged for pumping a suitable hydraulic fluid such as oil or the like from a reservoir 86 into a discharge or outlet line 87 at a constant output flow rate. Since the tool 11 is to be operated at extreme depths in boreholes, as at 12, which typically contain dirty and usually corrosive fluids, the reservoir 86 is preferably arranged to totally immerse the pump 84 and the motor 85 in the clean hydraulic fluid. The reservoir 86 is also provided with a spring-biased isolating piston 88 for maintaining the hydraulic fluid at a pressure about equal to the hydrostatic pressure at whatever depth the tool is then situated as well as for accommodating volumetric changes in the hydraulic fluid which may occur under different borehole conditions. One or more inlets, as at 89 and 90, are provided for returning hydraulic fluid from the control system 15 to the reservoir 86 during the operation of the new and improved tool 11.

The fluid outlet line 87 is divided into two major branch lines which are respectively designated as the "set" line 91 and the "retract" line 92. To control the admission of hydraulic fluid to the "set" and "retract" lines 91 and 92, a pair of normally-closed solenoid-actuated valves 93 and 94 are cooperatively equipped to selectively admit hydraulic fluid to the two lines as the control switch 22 at the surface is selectively positioned; and a typical check valve 95 is situated in the "set" line downstream of the control valve 93 for preventing the reverse flow of the hydraulic fluid whenever the pressure in the "set" line is greater than that then existing in the fluid outlet line 87. Typical pressure switches 96-98 are cooperatively situated in the "set" and "retract" lines 91 and 92 for selectively starting and stopping the pump 84 as required to maintain the line pressure within predetermined operating ranges commensurate with the rating of the pump.

Since the pump 84 is preferably a positive-displacement type to deliver a constant flow of fluid as well as to achieve a rapid predictable rise in the operating pressures in the system 15, each time the pump is started the control system also functions to temporarily open the control valve 94 (if it is not already open) as well as a third normally-closed solenoid-actuating valve 99 for momentarily returning hydraulic fluid directly to the reservoir. Once the motor 85 has reached operating speed, the "set" line control valve 93, the "retract" line control valve 94 and the bypass valve 97 will be selectively positioned as required for that particular operational phase of the tool 11.

Accordingly, it will be appreciated that the control system 15 cooperates for selectively supplying a constant volume of pressured hydraulic fluid to the "set" and "retract" lines 91 and 92. Since the pressure switches 96 and 97 respectively function only to limit the maximum pressures in the "set" and "retract" lines 91 and 92, the control system 15 is further designed to cooperatively supply hydraulic fluid at predetermined intermediate pressures to selected portions of the system during the several operational phases of the tool 11. Although this regulation can be accomplished in different manners, it is preferred to employ a number of pressure-actuated control valves such as those shown schematically at 100–103 in FIGS. 2A and 2B for controlling the hydraulic fluid in the control system 15. As shown in FIG. 2A, the hydraulic control valve 100, for example, includes a valve body 104 having an enlarged upper portion carrying a downwardly-biased actuating piston 105 which is slidably coupled to a valve member 106 that is itself normally urged into seating engagement by a spring 107 of selected strength.

In its non-actuating position depicted in FIG. 2A, the control valve 100 (as well as the valve 101) simply functions as a normally-closed check valve which opens only when the outlet pressure is sufficiently greater than the inlet pressure to overcome the predetermined closing force imposed by the spring 107. On the other hand, whenever the actuating piston 105 is elevated by the application of hydraulic pressure thereto, opposed shoulders, as at 108, on the valve member 106 and the piston will engage for unseating the valve member. As shown in FIGS. 2A and 2B, it will be appreciated that the control valve 102 (as well as the valve 103) is similar to the control valve 100 except that in the two first-mentioned control valves, the valve member, as at 109, is preferably rigidly coupled to its associated actuating piston, as at 110. Thus, the control valve 102 (as well as the valve 103) has no alternate checking action allowing reverse flow but is simply a normally-closed pressure-actuating valve for selectively controlling fluid communication between its inlet and outlet ports.

The "set" line 91 downstream of the check valve 95 includes a low-pressure section 111 which is coupled to the control port and fluid inlet of the hydraulic control valve 100 for selectively supplying hydraulic fluid to a high-pressure section 112 of the "set" line which is terminated at the fluid inlet of the hydraulic control valve 103. Thus, the high-pressure section 112 will be isolated from the low-pressure section 111 until the hydraulic pressure therein reaches the predetermined intermediate pressure required to open the hydraulic control valve 100 for admitting hydraulic fluid into the high-pressure line. The hydraulic control valves 102 and 103 are respectively arranged to selectively communicate the low-pressure and high-pressure sections 111 and 112 of the "set" line 91 with the fluid reservoir 86. To accomplish this, the control ports of these two valves 102 and 103 are each connected to the "retract" line 92 by suitable pressure-communicating lines 113 and 114. Thus, whenever the pressure in the "retract" line 92 successively reaches their respective predetermined actuating levels, the hydraulic control valves 102 and 103 will be selectively opened to exhaust hydraulic fluid in the two sections 111 and 112 of the "set" line 91 back to the reservoir 86 by way of the reservoir return line 90 coupled to the respective outlets of these two control valves.

As previously mentioned, in FIGS. 2A and 2B the new and improved tool 11 and the sub-surface portion of the control system 15 are depicted as their several components will appear when the tool-anchoring member 41 and the sealing pad 38 are respectively retracted against the tool body 18 to facilitate passage of the tool into the borehole 12. To prepare the tool 11 for lowering into the borehole 12, the switches 22 and 23 (FIG. 1) are moved from their first or "off" positions 24 to their second or "initialization" positions 25 to briefly start the hydraulic pump 84 (FIGS. 2A and 2B) for applying pressure to the "retract" line 92 to be certain that the pad 38 and the tool-anchoring member 41 are fully retracted. At this time, the pressure-equalizing valve 72 is still open and that portion of the flow line 66 between the closed sample-chamber control valves 70 and 71 and the new and improved fluid-admitting means 10 will be filled with borehole fluids as the tool 11 is being lowered into the borehole 12.

When the tool 11 is at a selected operating depth, the switches 22 and 23 are advanced to their third positions 26 to restart the pump 84. Then, once the pump 84 has reached its rated operating speed, the hydraulic pressure in the output line 87 will rapidly rise to its selected maximum operating pressure as determined by the maximum or "off" setting of the pressure switch 96. As the pressure progressively rises, the control system 15 will successively function at selected intermediate pressure levels for sequentially operating the several control valves 70–72 and 100–103.

Turning now to FIG. 3, selected portions of the control system 15 and various components of the tool 11 are schematically represented to illustrate the operation of the preferred embodiment of the new and improved tool and the fluid-admitting means 10 of the present invention at about the time that the pressure in the hydraulic output line 87 reaches its lowermost intermediate pressure level. To facilitate an understanding of the operation of the tool 11 and the control system 15 at this point in the operating cycle, only those components which are then operating are shown in FIG. 3.

At this time, since the control switch 22 (FIG. 1) is in its third position 26, the solenoid valves 93 and 99 will be open; and, since the hydraulic pressure in the "set" line 91 has not yet reached the upper pressure limit as determined by the pressure switch 96, the pump motor 85 will still be operating. Since the hydraulic control valve 100 (not shown in FIG. 3) is as yet unopened, the high-pressure section 112 of the "set" line 91 will still be isolated from the low-pressure section 111. At this time, hydraulic fluid in the low-pressure section 111 will be supplied by way of branch conduits, as at 115, to the rearward chambers of the actuators 40 and 42. Simultaneously, the hydraulic fluid contained in the forward pressure chambers of the piston actuators 40 and 42 will be displaced (as shown by the arrows as at 116) through appropriately-arranged conduits, as at 117 and 118, to the "retract" line 92 and returned to the reservoir 86 by way of the open solenoid valve 99 and the return line 90 (the solenoid valve 94 being closed). These actions will, of course, cause the tool-anchoring member 41 as well as the sealing pad 38 to be respectively extended in opposite lateral directions until each has moved into firm engagement with the opposite sides of the borehole 12. It should also be noted that at the same time, the hydraulic pressure in the low-pressure section 111 of the "set" line 91 is applied to the actuator 74 so that the normally-open pressure-equalizing valve 72 will now be closed at this point in the operating cycle.

It will be noticed in FIG. 3 that the hydraulic fluid in the low-pressure line 111 will be admitted at this time by way of a branch hydraulic line 119 to the enclosed annular chamber 45 at the rear of the enlarged-diameter portion 47 of the fluid-admitting member 43. At the same time, hydraulic fluid will be discharged from the forward chamber 46 by way of the branch hydraulic line 117 to the "retract" line 92 for progressively advancing the fluid-admitting member 43 in relation to the sealing pad 38 until its nose engages the wall of the borehole 12 and then halts. Once this occurs, the sealing pad 38 then moves forwardly in relation to the now-halted tubular member 43 for packing-off the isolated wall portion of the borehole 12 from the borehole fluids. In this manner, at least some of the mudcake on the wall of the borehole 12 will be displaced radially away from the nose of the fluid-admitting member 43 so as to minimize the quantity of unwanted mudcake which will subsequently enter the new and improved fluid-admitting means 10. This action will also cause the nose of the fluid-admitting member 43 to penetrate at least the mudcake lining the isolated wall portion of the borehole 12.

It should be noted that although the pressured hydraulic fluid is also admitted at this time into the forward chamber 56 ahead of the piston chamber 58, the plunger member 50 is initially prevented from moving rearwardly in relation to the inner and outer tubular members 43 and 44 inasmuch as the hydraulic control valve 101 (not shown in FIG. 3) is still closed thereby temporarily trapping the hydraulic fluid in the rearward piston chamber 57. The purpose of this delay in the retraction of the plunger member 50 will be subsequently explained.

Once the tool-anchoring member 41, the sealing pad 38, the fluid-admitting member 43 and the pressure-equalizing valve 72 have respectively reached their above-described positions, it will be appreciated that the hydraulic pressure delivered by the pump 84 will again rise. Then, once the pressure in the output line 87 has reached its second intermediate level of operating pressure, the hydraulic control valve 101 will open in response to this predetermined pressure level to now discharge the hydraulic fluid previously trapped in the piston chamber 57 to the rear of the plunger member 58 back to the reservoir 86. Thus, once the hydraulic control valve 101 opens, the hydraulic fluid will be displaced from the rearward piston chamber 57 by way of branch hydraulic lines 120, 121 and 117 to the "retract" line 92 as pressured hydraulic fluid from the "set" line 91 enters the piston chamber 56 ahead of the enlarged-diameter portion 58 of the plunger member 50. This will, of course, cooperate to start the plunger member 50 moving rearwardly in relation to the now-halted fluid-admitting member 43 as illustrated in FIG. 4.

It will be seen by comparison of FIGS. 3 and 4 that the advancement of the fluid-admitting member 43 in relation to the sealing pad 38 will ordinarily trap the small amount of mudcake, as at 122, which remains immediately in front of the enlarged head of the plunger 50 and within the confines of the nose of the fluid-admitting member 43. Thus, as the plunger 50 begins moving rearwardly toward its intermediate position illustrated in FIG. 4, the plug of mudcake, as at 122, that is then trapped within the nose of the now-stationary fluid-admitting member 43 will be progressively drawn into the fluid-admitting means 10 as the pressure is reduced in the expanding space 63 ahead of the plunger head.

It is also of paramount significance to the achievement of the objects of the present invention to realize that when the plunger 50 first starts rearwardly, the pressure in the chamber 56 will serve to hold the filter-covering member 51 temporarily stationary so that the initial retraction of the plunger will be effective for opening up an expansible particle-collecting chamber for receiving the unwanted mudcake plug 122 within the expanding portion of the inner bore 63 of the tubular member ahead of the now-retracting plunger head. Thus, since the filter-covering member 51 initially remains over the filter 48, the mudcake plug 122 will be safely drawn into the chamber beyond the rear of the filter to avoid the risk of plugging its ordinarily-minute filter passages.

In those situations where the formation, as at 13, which is to be tested is composed of substantially-unconsolidated or loose formation particles, it will be appreciated that as the plunger 50 continues its rearward movement, the further pressure reduction within the entrance to the new and improved fluid-admitting means 10 will be effective for inducting a sufficient, but limited, volume of these loose particles, as at 123, to begin filling the forward portion of the fluid-admitting member 43 ahead of the mudcake plug 122. This action will continue so that by the time the plunger 50 and the filter-covering member 51 are fully retracted, the fluid-admitting member 43 will have been advanced into the formation 13 to fill the void created as the loose formation materials 123 are simultaneously drawn into the expanding particle-collecting chamber 63 ahead of the plunger head. Thus, it is of particular significance to recognize that by the time the filter 48 is fully uncovered, the potentially-plugging mudcake plug 122 will be safely positioned well to the rear of the filter and the filter will be covered with a compacted column of clean formation particles as at 123.

On the other hand, where the formation being tested is relatively competent so that there will be few, if any, loose formation particles eroded from the isolated wall portion, the retraction of the plunger 50 will still be effective for removing the mudcake plug, as at 122, ahead of the fluid-admitting means 10. However, in this instance, there will be little or no penetration of the borehole wall by the fluid-admitting member 43; but the plunger 50 will still move rearwardly and, once the shoulder 62 is co-engaged with the plunger head, begin retracting the filter-covering member 51 as previously described. Nevertheless, the plug of mudcake removed from the nose of the fluid-admitting member 43 will be safely deposited well to the rear of the filter 48 by the time the plunger 50 and the filter-covering member 51 are fully retracted.

It will be appreciated, therefore, that regardless of the nature of a formation being tested, the new and improved fluid-admitting means 10 of the present invention will be effective for removing any potentially-plugging mudcake deposits from ahead of the nose of the fluid-admitting member 43 before any pressure measurements or fluid samples are obtained. As described above, the retraction of the plunger 50 will induct such mudcake deposits into the expansible particle-collecting chamber defined within the interior bore 63 of the filter-covering member 51 for carrying these deposits well to the rear of the filter 48 before it is exposed. Thus, where the formation to be tested is relatively incompetent or unconsolidated, as at 13, the operation of the new and improved fluid-admitting means 10 will cause a core of clean, uncontaminated formation materials, as at 123, to be pulled into the fluid-admitting member 43 in front of the mudcake plug 122. This core of clean particles 123 will, of course, serve as an additional filter media to prevent the further erosion of other loose formation materials during subsequent tests with the new and improved tool 11. On the other hand, where the formation to be tested is not particularly subject to erosion, the potentially-plugging mudcake deposit removed by retraction of the plunger 50 will still be carried past the filter 48 to the rear of the expansible particle-collecting chamber 63 defined within the filter-covering member 51.

Accordingly, once the several components of the formation-testing tool 11 and the control system 15 have reached their respective positions as collectively depicted in FIGS. 3 and 4, the hydraulic pressure in the output line 87 will again quickly increase to its next intermediate pressure level. Once the pump 84 has increased the hydraulic pressure in the output line 87 to this next predetermined intermediate pressure level, the hydraulic control valve 100 will selectively open. As fully described in the aforementioned U.S. Pat. No. 3,859,851, opening of the hydraulic control valve 100 will be effective for now supplying hydraulic fluid from the low-pressure section 111 to the high-pressure section 112 of the "set" line 91 and two paralleled branch conduits 124 and 125 thereof which are respectively coupled to the lower portions of the pressure-responsive actuators 82 and 83 for successively expanding the expansion chamber 78 and then the expansion chamber 79.

It will be realized from the previous discussion of the operation of the formation-testing tool 11 as collectively depicted in FIGS. 3 and 4 that as the expansion chambers 78 and 79 are being sequentially expanded, the sample-chamber control valves 70 and 71 as well as the pressure-equalizing valve 72 will be closed. At the same time, the plunger 50 and the filter-covering member 51 will be retracted to place the flow line 66 in pressure or fluid communication with the earth formation, as at 13, which is then being tested. Accordingly, the overall volume of the flow line 66 will be sequentially expanded first by an amount represented by the known displacement volume of the piston 80 and then by an additional amount represented by the known displacement volume of the piston 81. Thus, the formation, as at 13, being tested will be communicated with these brief sequential reductions in the pressure in the flow line 66. It will, however, be recognized that the ultimate pressure in the flow line 66 will be dependent upon the productivity of the formation, as at 13. Accordingly, by monitoring a pressure transducer, as at 126, arranged for sensing pressures in the flow line 66 as the chambers 78 and 79 are successively expanded, a series of meaningful measurements will be obtained which will take the general form of one of the four typical pressure records graphically depicted in FIGS. 7A–7D of the aforementioned U.S. Pat. No. 3,859,851. From these meaningful measurements, it can then be reliably predicted whether the formation being tested has sufficient potential to even warrant the collection of a large-volume sample. These predictions are, therefore, particularly worthwhile for estimating with a fair degree of accuracy how long the testing tool 11 must be left in position to collect a representative large-volume sample in one or both of the sample-collecting chambers 20 and 21. This advance knowledge will, of course, enable the operator to better evaluate the potential risks of sticking the tool 11 as well as to decide whether various preventative procedures must be initiated to at least minimize the chances that the tool will be stuck during the test.

Quickly summarizing the balance of the complete operating cycle of the new and improved tool 11, it will be appreciated that once the pistons 80 and 81 have moved to their respective chamber-expanding positions, the hydraulic pressure will again rise until such time that the "set" line pressure switch 96 operates to halt the hydraulic pump 84. Inasmuch as the pressure switch 96 has a selected operating range, in the typical situation the pump 84 will be halted shortly after the pistons 80 and 81 have completed their chamber-expanding operations. Once the several pressure measurements have been obtained for determining the productivity characteristics of the formation 13, a decision can be made whether it is advisable to obtain one or more samples of the producible connate fluids present in the earth formation. If such samples are not desired, the operator can simply operate the control switches 22 and 23 for retracting the tool-anchoring member 41 as well as the sealing pad 38 without further ado.

On the other hand, should a fluid sample be desired, the control switches 22 and 23 (FIG. 1) are advanced to their next or so-called "sample" positions 27 to open, for example, a solenoid valve 127 (FIG. 2B) for coupling pressured hydraulic fluid from the high-pressure section 112 of the "set" line 91 to the piston actuator 75 of the sample-chamber control valve 70. This will, of course, be effective for opening the control valve 70 to admit fluids through the flow line 66 and the branch conduit 68 into the sample chamber 20. If desired, a "chamber selection" switch 128 (FIG. 1) in the surface portion of the control system 15 could also be moved from its illustrated "first sample" position its so-called "second sample" position to to energize a solenoid valve 129 (FIG. 2B) for opening the sample-chamber control valve 71 to also admit connate fluids into the other sample chamber 21. In either case, one or more samples of the connate fluids which are present in the isolated earth formation 13 can be selectively obtained by the testing tool 11.

Upon moving the control switches 22 and 23 to their so-called "sample-trapping" positions 28, the pump 84 will again be restarted. Once the pump 84 has reached operating speed, it will commence to operate much in the same manner as previously described and the hydraulic pressure in the output line 87 will again begin rising with momentary halts at various intermediate pressure levels.

Accordingly, when the control switches 22 and 23 have been placed in their "sample trapping" positions 28 (FIG. 1), the solenoid valve 94 will open to admit hydraulic fluid into the "retract" line 92 (FIGS. 2A and 2B). By means of the electrical conductor 32, however, the pressure switch 98 is enabled and the pressure switch 97 is disabled so that in this fifth position of the control switches 22 and 23, the maximum operating pressure which the pump 84 can initially reach is limited to the pressure at the operating level determined by the pressure switch 98. Thus, by arranging the hydraulic control valve 103 to open in response to a hydraulic pressure corresponding to this lower predetermined pressure level, hydraulic fluid in the high-pressure section 112 of the "set" line 91 will be returned to the reservoir 86 by means of the return line 90. As the hydraulic fluid in the high-pressure section 112 returns to the reservoir 86, the pressure in this portion of the "set" line 91 will be rapidly decreased to close the hydraulic control valve 100 once the pressure in the "set" line is insufficient to continue holding the valve open. Once the hydraulic control valve 100 closes, the pressure remaining in the low-pressure section 111 of the "set" line 91 will remain at a reduced pressure which is nevertheless effective for retaining the tool-anchoring member 41 and the sealing pad 38 fully extended.

As hydraulic fluid is discharged from the lower portion of the piston actuator 75 by way of the still-open solenoid valve 127 and fluid from the "retract" line 92 enters the upper portion of the actuator by way of a branch line 130, the sample-chamber control valve 70 will close to trap the sample of connate fluids which is then present in the sample chamber 20. Similarly, should a fluid sample have also been collected in the other sample chamber 21, the sample-chamber control valve 71 can also be readily closed by operating the switch 128 (FIG. 1) to reopen the solenoid valve 129. Closure of the sample-chamber control valve 70 (as well as the valve 71) will, of course, be effective for trapping any fluid samples collected in one or the other or both of the sample chambers 20 and 21.

Once the sample-chamber control valve 70 (and, if necessary, the control valve 71) has been reclosed, the control switches 22 and 23 are moved to their next or so-called "retract" switching positions 29 for initiating the simultaneous retraction of the tool-anchoring member 41 and the sealing pad 38. In this final position 29 of the control switch 23, the pressure switch 98 is again rendered inoperative and the pressure switch 97 is enabled so as to now permit the hydraulic pump 84 to be operated at its full rated capacity for attaining hydraulic pressures greater than the first intermediate operating level in the "retract" cycle. One the pressure switch 98 has again been disabled, the pressure switch 97 will now function to operate the pump 84 so that the pressure will then quickly rise until it reaches the next operating level where the hydraulic control valve 102 is opened.

At this point, hydraulic fluid which had been previously supplied through the "retract" line 92 and a branch hydraulic line 131 will be effective for reopening the pressure-equalizing control valve 72 to readmit borehole fluids into the flow line 66 as the hydraulic fluid displaced from the piston actuator 74 is returned to the reservoir 86 by way of the now-opened hydraulic control valve 102 and the return line 90. Opening of the pressure-equalizing valve 72 will, of course, admit borehole fluids into the isolated space defined by the sealing pad 38 so as to equalize the pressure differential existing across the pad before it is retracted.

When the hydraulic control valve 102 opens to communicate the low-pressure section 111 of the "set" line 91 with the reservoir 86, hydraulic fluid in the "retract" line will be admitted to the "retract" sides of the several piston actuators 40 and 42. Similarly, the pressured hydraulic fluid will also be admitted into the annular space 46 in front of the enlarged-diameter piston portion 47 for retracting the fluid-admitting member 43 as well as admitting fluid into the annular space 57 for returning the plunger member 50 and the filter-covering member 51 to their forward positions. It should be noted that as the plunger 50 first moves forwardly in relation to the filter-covering member (i.e. before the piston member 58 co-engages the piston portion 61), the enlarged forward end of the plunger will be effective for displacing the mudcake plug 122 and any collected formation particles, as at 123, from the chamber 63. Thus, the new and improved fluid-admitting means 10 is fully resettable to allow additional tests or pressure measurements to be made.

The hydraulic fluid exhausted from the several piston actuators 40 and 42 as well as from the piston chambers 45 and 56 will be returned directly to the reservoir 86 by way of the low-pressure section 111 of the "set" line 91 and the hydraulic control valve 102. This action will, of course, retract the tool-anchoring member 41 as well as the sealing pad 38 against the tool body 18 to permit the tool 11 either to be repositioned in the borehole 12 or to be returned to the surface if no further testing is desired.

It should be noted that although there is an operating pressure applied to a branch conduit 132 leading to the piston actuators 82 and 83 at the time that the pressure-equalizing valve 72 is reopened, a normally-closed relief valve 133 which is paralleled with an oppositely-directed check valve 134 is temporarily held in a closed position until the increasing hydraulic pressure developed by the pump 84 exceeds the operating level used to retract the tool-anchoring member 41 and the sealing pad 38. At this point in the operating sequence of the new and improved tool 11, the displacement pistons 80 and 81 will be restored to their respective lower positions as hydraulic fluid in the lower portion of the actuators 82 and 83 returns to the reservoir 86 by way of the branch conduits 124 and 125, the hydraulic control valve 103, and the return line 90. This delay is provided to be certain that the pressure-equalizing valve 72 is reopened so as to prevent an excessive pressure buildup in the flow line 66 which would otherwise occur when the displacement pistons 80 and 81 are returned to their lower positions.

The pump 84 will, of course, continue to operate until such time that the hydraulic pressure in the output line 87 again reaches the upper limit determined by the setting of the pressure switch 97. At some convenient time thereafter, the control switches 22 and 23 are again returned to their initial or "off" positions 24 for halting further operation of the pump motor 85 as well as closing the solenoid valve 94 and reopening the solenoid valve 99 to again communicate the "retract" line 92 with the fluid reservoir 86. This completes the operating cycle of the illustrated embodiment of the new and improved tool 11.

Accordingly, it will be appreciated that the new and improved fluid-admitting means 10 of the present invention enable a formation-testing tool, such as that shown herein at 11, to be operated for testing any type of formation which may be encountered during a formation-testing operation. By initially inducting any potentially-plugging mudcake deposits into the fluid-admitting means before any pressure measurements are made or any fluid samples are collected, it can be reasonably expected that a complete testing or sampling operation can be carried out. Thus, with the new and improved fluid-admitting means described herein, tests may now be conducted in various types of formations without needlessly risking the plugging of a tool.

While only a particular embodiment of apparatus of the present invention have been shown and described, it is apparent that changes and modifications may be made without departing from this invention in its broader aspects; and, therefore, the aim in the appended claims is to cover all such changes and modifications as fall within the true spirit and scope of the present invention.

What is claimed is:

1. Formation-testing apparatus adapted for testing earth formations penetrated by a borehole and comprising:

a support;

fluid-admitting means on said support defining a fluid entry adapted for engagement with a borehole wall, fluid passage means in said fluid-admitting means, and filtering means cooperatively intercommunicating said fluid entry and said fluid passage means and adapted to retain inflowing loose formation particles as connate fluids from earth formations therebeyond pass through said filtering means into said fluid passage means;

means on said support adapted for selectively engaging said fluid-admitting means with an adjacent borehole wall to place said fluid entry into isolated communication with earth formations therebeyond;

particle-collecting means on said support adapted for clearing said fluid entry of particles of plugging materials situated on an adjacent borehole wall and in isolated communication therewith and including a first movable member defining a forwardly-opening particle-receiving chamber normally situated at an advanced position in said fluid entry ahead of said filtering means and adapted for movement rearwardly therefrom to a retracted position for carrying such plugging materials from said fluid entry and communicating said fluid entry with said filtering means, a second movable member cooperatively arranged within said particle-receiving chamber and adapted for movement therein between an advanced position for blocking said particle-receiving chamber and an intermediate position for expanding said particle-receiving chamber to induct such plugging materials into said particle-receiving chamber ahead of said second member, and means cooperatively arranged on said first and second movable members and adapted for moving said first movable member toward its said retracted position as said second movable member is moved further beyond its said intermediate position toward a more-retracted position; and selectively-operable actuating means on said support cooperatively arranged for repetitively moving said first and second movable members back and forth between their respective said positions.

2. The formation-testing apparatus of claim 1 wherein the volume of said particle-receiving chamber is at least about equal to the volume of such plugging materials expected to be isolated upon engagement of said fluid-admitting means with an adjacent borehole wall.

3. The formation-testing apparatus of claim 1 further including:

packing means operatively mounted on said fluid-admitting means around said fluid entry and adapted to be sealingly engaged with an adjacent borehole wall when said fluid-admitting means are engaged therewith.

4. The formation-testing apparatus of claim 1 further including:

pressure-monitoring means cooperatively coupled to said fluid passage means and adapted for providing signals representative of the pressure of fluids therein.

5. The formation-testing apparatus of claim 1 further including:

sample-collecting means on said support including a sample chamber adapted for receiving connate fluids, and means adapted for selectively communicating said sample chamber with said fluid passage means.

6. The formation-testing apparatus of claim 5 further including:

pressure-monitoring means cooperatively coupled to said fluid passage means and adapted for providing signals representative of the pressure of fluids therein.

7. Formation-testing apparatus adapted for obtaining samples of connate fluids from earth formations penetrated by a borehole and comprising:

a support;

fluid-admitting means including a tubular fluid-admitting member cooperatively arranged for lateral movement on said support from a retracted position to an advanced position in fluid communication with a borehole wall lined with fluent plugging materials, and a tubular filter adapted for passing connate fluids and retaining loose formation materials coaxially arranged within said fluid-admitting member and defining a fluid-receiving space therebetween;

sample-collecting means on said support including a sample receiver adapted for receiving connate fluids entering said fluid-admitting member and passing through said tubular filter, and fluid passage means cooperatively arranged between said sample receiver and said fluid-receiving space;

a first movable member defining a forward-opening material-receiving chamber adapted for receiving fluent plugging materials entering said fluid-admitting member coaxially arranged in said fluid-admitting member and said tubular filter and adapted for longitudinal movement therein between an advanced position blocking said tubular filter and a retracted position uncovering at least a major portion of said tubular filter;

a second movable member coaxially arranged within said first movable member normally located in an advanced position for closing the forward end of said material-receiving chamber and adapted for longitudinal movement therein to an intermediately-retracted position for inducting fluent plugging materials into said material-receiving chamber as it is expanded upon said movement of said second movable member therein to its said intermediately-retracted position;

means operatively associated with said first and second movable members and adapted for carrying said first movable member toward its said retracted position only after said second movable member has reached its said intermediately-retracted position and is then moved further toward a more-retracted position to carry said first movable member through said tubular filter and expose at least a portion thereof to at least limit the further entrance of loose formation materials into said fluid-admitting member; and control means on said support and cooperatively arranged for selectively moving said fluid-admitting member and said first and second movable members back and forth between their respective advanced and retracted positions.

8. The formation-testing apparatus of claim 7 further including:

packing means operatively mounted on said fluid-admitting means around said fluid-admitting member and adapted for sealingly engaging a borehole wall upon extension of said fluid-admitting member toward its said advanced position.

9. The formation-testing apparatus of claim 7 wherein said means operatively associated with said first and second movable members include:

opposed shoulders respectively arranged on said first and second movable members and cooperatively positioned thereon so that said opposed shoulders are spatially separated whenever said first and second movable members are in their respective advanced positions and said opposed shoulders are coengaged as said second movable member is moved to its said intermediately-retracted position, and means normally biasing said first movable member toward its said advanced position until said opposed shoulders are coengaged and said first movable member is carried toward its said retracted position as said second movable member is moved further toward its said more-retracted position.

10. The formation-testing apparatus of claim 7 wherein said control means include:

selectively-operable hydraulic means cooperatively arranged for developing elevated actuating pressures; and first and second piston actuators respectively coupled to said first and second movable members and cooperatively coupled to said hydraulic means for selectively moving said first and second movable members between their respective advanced and retracted positions in response to said elevated actuating pressures.

11. The formation-testing apparatus of claim 7 further including:

pressure-monitoring means cooperatively coupled to said fluid passage means and adapted for providing signals representative of the pressure of fluids therein.

12. Formation-testing apparatus adapted for testing earth formations penetrated by a borehole and comprising:

a support;

fluid-admitting means on said support including a packing member defining a fluid entry and adapted for engagement with a borehole wall for isolating a portion thereof from borehole fluids and placing said fluid entry into isolated communication with earth formations therebeyond, fluid passage means between said support and said fluid entry, and a tubular filter member coaxially arranged within said fluid entry and adapted to retain inflowing loose formation particles as connate fluids from earth formations therebeyond pass laterally through said filter member into said fluid passage means;

particle-collecting means on said support including inner and outer movable members coaxially arranged within said fluid-admitting means with said outer member having a forward portion defining a forwardly-opening particle-receiving chamber situated in said fluid entry ahead of said filter member for blocking said filter member when said outer member is in an advanced position and adapted for movement rearwardly therefrom to a retracted position for uncovering said filter member, said inner member having an enlarged forward portion cooperatively arranged within said particle-receiving chamber for closing the forward end thereof when said inner member is in an advanced position and adapted for movement rearwardly therein to an intermediately-retracted position for expanding said particle-receiving chamber to induct plugging materials from an isolated borehole wall ahead of said fluid entry into said particle-receiving chamber and thereafter carrying said outer member toward its said retracted position to remove such plugging materials from the flow path through said filter member as said inner member moves toward a fully-retracted position;

actuating means including first and second piston means on the rearward of said inner and outer members respectively and means on said fluid-admitting means defining a piston chamber for receiving said first and second piston means and providing a rearward enclosed spaced behind said first piston means and a forward enclosed space ahead of said first piston means and behind said second piston means; and selectively-operable control means on said support and cooperatively arranged for alternately supplying a pressured actuating fluid to said forward enclosed space for moving said inner member from its said advanced position toward its said retracted position and temporarily biasing said outer member toward its said advanced position until said inner member reaches its said intermediately-retracted position and carries said outer member toward its said retracted position as said inner member continues toward its said fully-retracted position and for alternately supplying a pressured actuating fluid to said rearward enclosed space for moving said inner and outer members from their said retracted positions toward their said advanced positions.

13. The formation-testing apparatus of claim 12 further including:

pressure-monitoring means cooperatively coupled to said fluid passage means and adapted for providing signals representative of the pressure of fluids therein.

14. The formation-testing apparatus of claim 12 further including:

sample-collecting means on said support including a sample chamber adapted for receiving connate fluids, and means adapted for selectively communicating said sample chamber with said fluid passage means.

15. The formation-testing apparatus of claim 14 further including:

pressure-monitoring means cooperatively coupled to said fluid passage means and adapted for providing signals representative of the pressure of fluids therein.

16. Formation-testing apparatus adapted for obtaining samples of connate fluids from earth formations penetrated by a borehole and comprising:

a support;

fluid-admitting means including a tubular fluid-admitting member movably mounted on said support and adapted to be extended from a retracted position to an advanced position for establishing communication with a borehole wall lined with fluent plugging materials, and filtering means adapted for passing connate fluids and retaining loose formation materials cooperatively arranged within said fluid-admitting member and defining a fluid-receiving space therebetween along an intermediate portion of the internal wall of said fluid-admitting member;

sample-collecting means on said support including a sample receiver adapted for receiving connate fluids, fluid passage means arranged between said sample receiver and said fluid-receiving space for conducting connate fluids passing through said filtering means into said sample receiver, and selectively-operable valve means adapted for controlling communication between said fluid passage means and said sample receiver;

a movable material receiver coaxially disposed in said fluid-admitting member defining a forwardly-opening chamber for receiving fluent plugging materials entering said fluid-admitting member and adapted for longitudinal movement back and forth therein between an advanced position ahead of said filtering means and a retracted position to the rear of said filtering means;

first means operable following placement of said fluid-admitting member against a borehole wall for inducting fluent plugging materials therefrom into said chamber;

second means operable upon the induction of fluent plugging materials into said chamber for shifting said material receiver from its said advanced position to its said retracted position to carry such plugging materials out of the flow path to said filtering means and then to expose at least a portion of said filtering means for the admission of connate fluids into said fluid-admitting member; and control means selectively operable for repetitively moving said fluid-admitting member between its said extended and retracted positions as well as repetitively operating said first and second means to successively admit connate fluids into said fluid passage means.

17. The formation-testing apparatus of claim 16 further including:

packing means operatively mounted on said fluid-admitting means and adapted for sealing engagement with a borehole wall upon extension of said fluid-admitting member to its said advanced position.

18. The formation-testing apparatus of claim 16 further including:

pressure-monitoring means cooperatively coupled to said fluid passage means and adapted for providing signals representative of the pressure of fluids therein.

19. The formation-testing apparatus of claim 16 wherein said first means include a plunger member movably arranged within said chamber for movement relative thereto between an advanced position to a retracted position for inducting plugging materials into said chamber.

20. The formation-testing means of claim 19 wherein said second means include opposed surfaces cooperatively arranged on said plunger member and said material receiver respectively and adapted to be coengaged for shifting said material receiver to its said retracted position only as said plunger member is being moved to its said retracted position, and biasing means normally urging said material receiver towards its said advanced position until said opposed shoulders are coengaged.

21. Formation-testing apparatus adapted for testing earth formations penetrated by a borehole and comprising:

a support;

fluid-admitting means on said support and including packing means having a central opening therein and adapted for engagement with a borehole wall lined with fluent plugging materials to isolate a portion thereof adjacent to said central opening from borehole fluids, a tubular fluid-admitting member having a forward portion projecting through said central opening, a tubular filter member cooperatively mounted within said fluid-admitting member and defining a fluid-receiving space therebetween along the internal wall of the intermediate portion of said fluid-admitting member, and fluid passage means communicated with said fluid-receiving space;

means cooperatively arranged on said support for selectively clearing fluent plugging materials from an isolated portion of a borehole wall adajcent to said central opening and including a tubular material-receiving member coaxially arranged for movement within said fluid-admitting member and having an enlarged forward portion defining a forwardly-opening chamber, a plunger member coaxially arranged for movement within said material-receiving member and having an enlarged plunger head disposed in said forwardly-opening chamber and an enlarged piston head disposed to the rear of the rearward portion of said material-receiving member, and means defining a piston chamber around said enlarged piston head and said rearward portion of said material-receiving member and providing an enclosed rearward space to the rear of said enlarged piston head and an enclosed forward space between said enlarged piston head and said rearward portion of said material-receiving member; and control means on said support and cooperatively arranged for alternately directing a pressured hydraulic fluid into said enclosed rearward space for selectively moving said plunger member forwardly from a retracted position to an advanced position where said enlarged piston head has engaged said rearward portion of said material-receiving member to carry said material-receiving member forwardly from a fully-retracted position to an advanced position where said enlarged forward portion thereof is in said forward portion of said fluid-admitting member for blocking communication with said filter member and said enlarged plunger head is in the forward portion of said forwardly-opening chamber for closure thereof and for alternately directing a pressured hydraulic fluid into said enclosed forward space for selectively moving said plunger member rearwardly to an intermediate retracted position and temporarily biasing said material-receiving member toward its said advanced position until said enlarged plunger head is moved fully into said forwardly-opening chamber for expanding said forwardly-opening chamber to induct fluent plugging materials thereinto and thereafter carrying said material-receiving member toward its said retracted position as said plunger member is moved toward its said fully-retracted position for opening communication with said filter member and carrying fluent plugging materials in said forwardly-opening chamber to the rear of said filter member.

22. The formation-testing apparatus of claim 21 further including:

sample-collecting means on said support including a sample receiver adapted for receiving connate fluids, and selectively-operable valve means adapted for controlling communication between said fluid passage means and said sample receiver.

23. The formation-testing apparatus of claim 21 further including:

pressure-monitoring means cooperatively coupled to said fluid passage means and adapted for providing signals representative of the pressure of fluids therein.

24. The formation-testing apparatus of claim 21 further including:

pressure-monitoring means cooperatively coupled to siad fluid passage means and adapted for providing signals representative of the pressure of fluid therein; and sample-collecting means on said support including a sample receiver adapted for receiving connate fluids, and selectively-operable valve means adapted for controlling communication between said fluid passage means and said sample receiver.

25. The formation-testing apparatus of claim 21 wherein the volume of said forwardly-opening chamber which is unoccupied by said enlarged plunger head is about equal to the anticipated volume of fluent plugging materials expected to be on an isolated borehole wall portion adjacent to said central opening.

* * * * *